US008466629B2

(12) United States Patent
Liu

(10) Patent No.: US 8,466,629 B2
(45) Date of Patent: Jun. 18, 2013

(54) LAMP TUBE WITH DETACHABLE POWER RECTIFIER MEMBER

(75) Inventor: Jun-Ping Liu, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 338 days.

(21) Appl. No.: 12/916,608

(22) Filed: Oct. 31, 2010

(65) Prior Publication Data

US 2011/0309761 A1 Dec. 22, 2011

(30) Foreign Application Priority Data

Jun. 17, 2010 (CN) ..... 2010 1 0202042

(51) Int. Cl.
*H05B 37/02* (2006.01)

(52) U.S. Cl.
USPC .. 315/209 R; 313/578; 313/634; 313/318.12; 313/292

(58) Field of Classification Search
None
See application file for complete search history.

(56) References Cited

U.S. PATENT DOCUMENTS

| | | | | |
|---|---|---|---|---|
| 5,086,249 | A * | 2/1992 | Blaisdell et al. | 313/318.1 |
| 6,548,948 | B1 * | 4/2003 | Muessli | 313/318.01 |
| 2006/0186782 | A1 * | 8/2006 | Ciancanelli et al. | 313/318.01 |

FOREIGN PATENT DOCUMENTS

| | | | |
|---|---|---|---|
| CN | 101576209 | A | 11/2009 |
| CN | 101614331 | A | 12/2009 |
| CN | 201425176 | Y | 3/2010 |
| CN | 101725926 | A | 6/2010 |

* cited by examiner

*Primary Examiner* — Ashok Patel
(74) *Attorney, Agent, or Firm* — Altis Law Group, Inc.

(57) ABSTRACT

A lamp tube includes a encapsulation and a power rectifier member. The power rectifier member includes a power rectifier to convert alternating current (AC) energy into direct current (DC) energy. A first holder defining a first cavity for receiving the power rectifier, and a second cavity for detachably receiving and electrically connecting with one end of the encapsulation; and a first side cover detachably connected to the first holder to cover the first cavity.

12 Claims, 3 Drawing Sheets

LAMP TUBE WITH DETACHABLE POWER RECTIFIER MEMBER

BACKGROUND

1. Technical Field

The present disclosure relates to lamp tubes, particularly, to an lamp tube with detachable power rectifier member.

2. Description of Related Art

A conventional LED lamp usually includes a encapsulation and a power rectifier securely fixed to one end of the encapsulation. The encapsulation is usually more durable than the power rectifier. Once the rectifier is damaged, the whole LED lamp cannot be used again.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
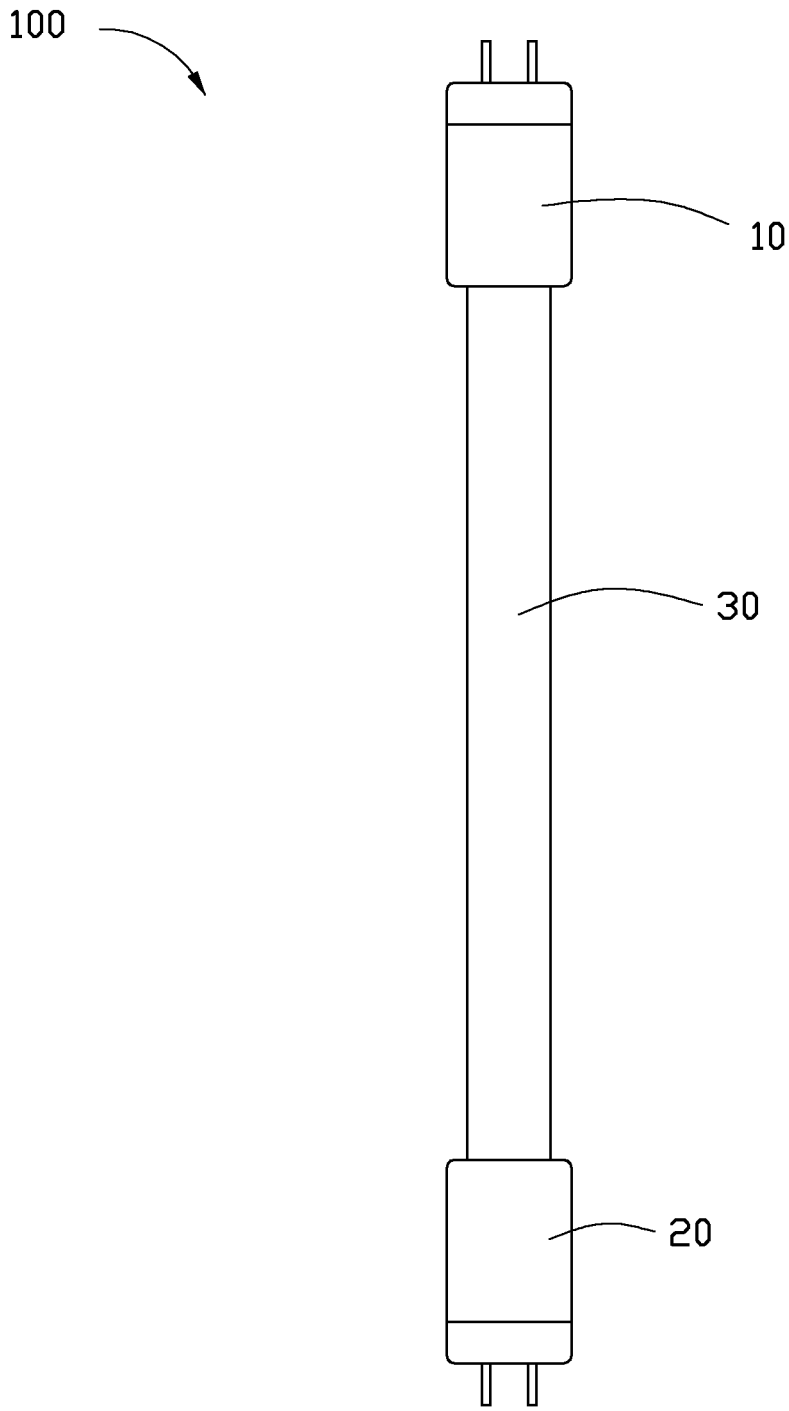
FIG. 1 is a schematic view of a lamp tube with detachable power rectifier member in accordance with an exemplary embodiment.

Referring to FIG. 1, in an embodiment, an LED lamp tube 100 includes a power rectifier member 10, a fixing member 20, and a encapsulation 30 that houses electronic components (not shown), such as a PCB and a number of light emitting diodes (LEDs) mounted on the PCB. The power rectifier member 10 and the fixing member 20 are removably connected to opposite ends of the encapsulation 30.

Figure 2:
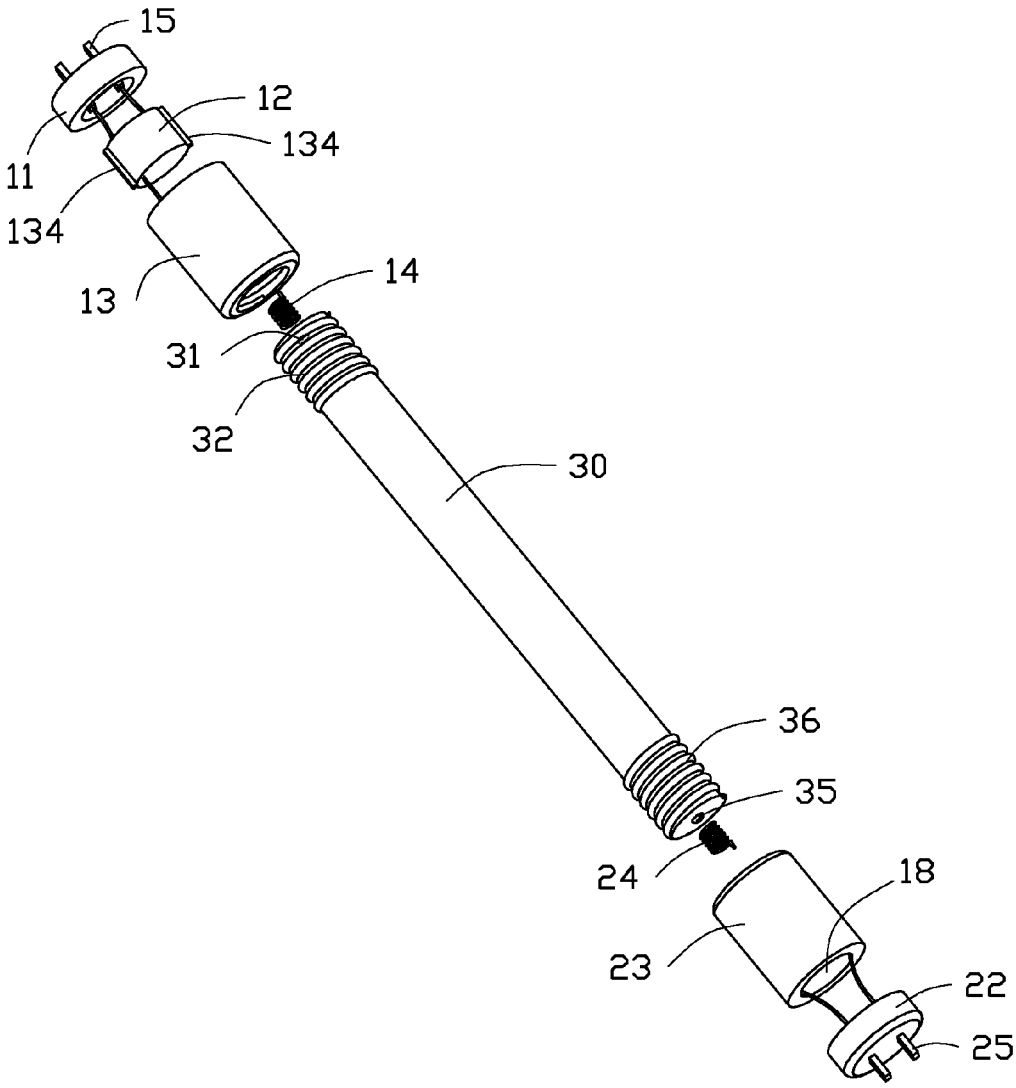
FIG. 2 is an exploded view of the lamp tube of FIG. 1.
Figure 3:
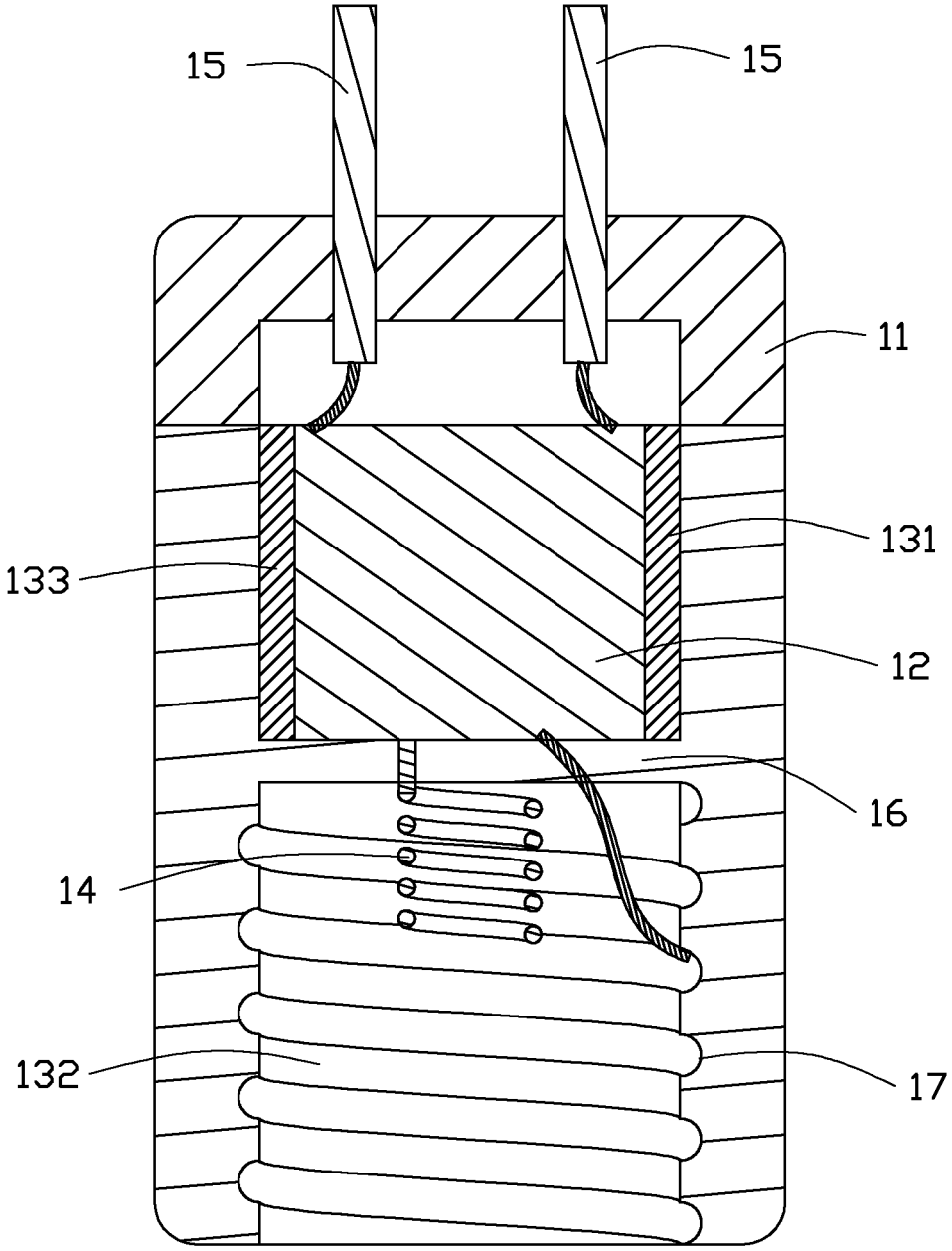
FIG. 3 is a cross-sectional view of a power rectifier member of the lamp tube FIG. 1.

Referring to FIGS. 2 and 3, the power rectifier member 10 includes a first side cover 11, a power rectifier 12, a first holder 13, and a first conductive spring member 14. The power rectifier 12 is employed to covert AC power to DC power. The first holder 13 is a hollow tube and defines a first cavity 131 and a second cavity 132 separated from the first cavity 131 by a spacer 16. The first cavity 131 is used to receive the power rectifier 12, and the second cavity 132 is used to receive a first end of the encapsulation 30.

Two grooves 133 are formed in the internal surface of the first cavity 131. Two ribs 134 protrude from a lateral surface of the power rectifier 12 and are respectively engaged into the two grooves 133 of the first cavity 131, to prevent the power rectifier 12 from rotating relative to the first cavity 131. An electrical-conductive internal thread 17 is formed in the internal lateral surface of the second cavity 132. An electrical-conductive external thread 32 is formed in the lateral surface of the first end of the encapsulation 30. The first holder 13 can thus be engaged with the encapsulation 30 by the engagement of the internal thread 17 with the external thread 32.

One end of the first conductive spring member 14 penetrates and is fixed to the spacer 16, and is connected to the power rectifier 12. The other opposite end of the first conductive spring member 14 abuts against a conductive portion 31 on one end of the encapsulation 30, which electrically connects the encapsulation 30 to the power rectifier 12.

The first side cover 11 is detachably connected to one end of the first holder 13 and covers the fist cavity 131 of the first holder 13. A pair of contact pins 15 protrudes from and is fixed to one end of the first side cover 11, and is electrically connected to two pins of the power rectifier 12. In the embodiment, the contact pins 15 are made of electrically conductive material, such as copper or aluminum.

One electrode of the power rectifier 12 is electrically connected to the internal thread 17 of the first cavity 131 and grounded by the first cavity 131. The other electrode of the power rectifier 12 is electrically connected to the first conduction spring 14, thus the power rectifier 12 is electrically connected with the encapsulation 30 by the first conduction spring 14.

The fixing member 20 includes a second side cover 22 and a second holder 23. One end of the second holder 23 is fixed to the second side cover 22, and the other opposite end of the second holder 23 is detachably connected to a second end of the encapsulation 30. In the embodiment, an electrical-conductive internal thread 18 is formed in the internal lateral surface of the second holder 23, adjacent to the encapsulation 30. An electrical-conductive external thread 36 is formed in the lateral surface of the second end of the encapsulation 30. The second holder 23 can thus be engaged with the encapsulation 30 by the engagement of the internal thread 18 with the external thread 36. A second conductive spring member 24 is fixed to the bottom of the second side cover 22, and includes a free end abutting against a conductive portion 35 on an end of the encapsulation 30. A pair of contact pins 25 protrudes from and is fixed to one end of the second side cover 22, and is electrically connected to the second conductive spring member 24.

In the embodiment, the encapsulation 30 includes a lamp-house, a base plate (not shown) and a number of LED lamps (not shown) electrically connected mutually in series to the base plate. The base plate and the LED lights are enclosed in the light-house. Both ends of the LED lamps electrically connect with the power rectifier member 10 and the fixing member 20 correspondingly by the conductive portions 31 and 35.

When needed, the power rectifier member 10 can be detached from the encapsulation 30 and replaced with a new one. The service life the LED lamp tube 100 can thus be prolonged.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. A lamp tube comprising:

a encapsulation and a power rectifier member comprising:

a power rectifier;

a first holder defining a first cavity for receiving the power rectifier, and a second cavity for detachably receiving and electrically connecting with one end of the encapsulation; and a first side cover detachably connected to the first holder to cover the first cavity;

wherein the power rectifier comprises at least one rib, the first cavity defines at least one groove, the at least one rib is engaged into the at least one groove to prevent the power rectifier from rotating relative to the first cavity.

2. The lamp tube as described in claim 1, wherein the first cavity and the second cavity are separated by a spacer.

3. The lamp tube as described in claim 2, wherein the power rectifier member further comprises a first conductive spring member, one end of the first conductive spring member penetrates and is fixed to the spacer, and is connected to the power rectifier; the other opposite end of the first conductive spring member abuts against on one end of the encapsulation.

4. The lamp tube as described in claim 3, wherein a first end of the encapsulation forms a conductive portion configured to electrically connect with the first conductive spring member.

5. The lamp tube as described in claim 1, wherein a pair of contact pins protrudes from and is fixed to one end of the first side cover, and is electrically connected to the power rectifier.

6. The lamp tube as described in claim 1, wherein the lamp tube further comprises a fixing member, the fixing member comprises a second holder and a second side cover fixed to the second holder; one end of the second holder is fixed to the second side cover, and the other opposite end of the second holder is detachably connected to a second end of the encapsulation.

7. The lamp tube as described in claim 6, wherein the fixing member further comprises a second conductive spring member, the second conductive spring member is fixed on the bottom of the second side cover, and includes a free end abutting against a conductive portion on the second end of the encapsulation.

8. The lamp tube as described in claim 6, wherein the second end of the encapsulation forms a conductive portion configured to electrically connect with the second conductive spring member.

9. The lamp tube as described in claim 6, wherein a pair of contact pins protrudes from and is fixed to one end of the second side cover, and is electrically connected to the second conductive spring member.

10. The lamp tube as described in claim 6, wherein two conductive external threads are formed on the opposite ends of the encapsulation.

11. The lamp tube as described in claim 10, wherein a first internal thread is formed in the internal lateral surface of the second cavity and engages with the conductive external thread of one end of the encapsulation; a second internal thread is formed in the internal lateral surface of the second fixing holder and engages with the conductive external thread of the other opposite end of the encapsulation.

12. The lamp tube as described in claim 11, wherein one electrode of the power rectifier is electrically connected to the first internal thread of the second cavity and grounded by the second cavity; the other electrode of the power convertor is electrically connected to the first conduction spring member.

* * * * *